US010895238B2

(12) United States Patent
Fujita et al.

(10) Patent No.: US 10,895,238 B2
(45) Date of Patent: Jan. 19, 2021

(54) STARTER FOR INTERNAL COMBUSTION ENGINE

(71) Applicant: DENSO CORPORATION, Kariya (JP)

(72) Inventors: Tatsuya Fujita, Kariya (JP); Takashi Hirabayashi, Kariya (JP); Tasuku Yamada, Kariya (JP); Mitsuhiro Murata, Kariya (JP)

(73) Assignee: DENSO CORPORATION, Kariya (JP)

( * ) Notice: Subject to any disclaimer, the term of this patent is extended or adjusted under 35 U.S.C. 154(b) by 83 days.

(21) Appl. No.: 15/821,239

(22) Filed: Nov. 22, 2017

(65) Prior Publication Data

US 2018/0149130 A1 May 31, 2018

(30) Foreign Application Priority Data

Nov. 25, 2016 (JP) ..... 2016-228660

(51) Int. Cl.
*F02N 15/06* (2006.01)

(52) U.S. Cl.
CPC ..... *F02N 15/063* (2013.01); *F02N 15/067* (2013.01); *F02N 2015/061* (2013.01)

(58) Field of Classification Search
CPC ..... F02N 15/063; F02N 15/065; F02N 15/06; F02N 2015/061; F02N 12/022; F02N 11/0851; F02N 15/003; Y10T 74/13; Y10T 74/131; Y10T 74/134
USPC ..... 74/7 R, 6, 7 C
See application file for complete search history.

(56) References Cited

U.S. PATENT DOCUMENTS 2,349,146 A * 5/1944 Dickson ..... F02N 15/028 74/7 R
5,688,203 A * 11/1997 Yamamoto ..... F02N 15/046 475/331
5,848,551 A * 12/1998 Ohmi ..... F02N 15/067 74/7 C
5,905,310 A * 5/1999 Nagao ..... F02N 15/046 290/36 R
6,658,949 B2 * 12/2003 Saito ..... F02N 15/067 267/158
6,993,989 B2 * 2/2006 Oomura ..... F02N 15/046 123/182.1

(Continued)

FOREIGN PATENT DOCUMENTS

DE 102010041691 B4 * 9/2019 ..... F02N 11/00
JP S6026285 U * 2/1985 ..... F02N 11/00

(Continued)

*Primary Examiner* — Bobby Rushing, Jr.
(74) *Attorney, Agent, or Firm* — Oliff PLC

(57) ABSTRACT

A starter for an internal combustion engine includes a rotating shaft formed with a helical spline on an outer periphery thereof and which rotates by a rotation of a motor, a pinion gear helically splined to the rotating shaft and movable in an axial direction of the rotating shaft along a tooth surface of the helical spline, a lever receiving member disposed opposing an end surface in an axial direction of the pinion gear, moved by receiving an axial pushing force by a pushing member, and causing the pinion gear to engage with a ring gear of the internal combustion engine by a movement thereof, and a buffer member for restricting a movement of the pinion gear in a rotational direction when the pinion gear moves along the teeth surface of the helical spline.

4 Claims, 7 Drawing Sheets

(56) References Cited

U.S. PATENT DOCUMENTS

| | | | | |
|---|---|---|---|---|
| 7,010,992 | B2 * | 3/2006 | Katoh | F02N 15/046 475/347 |
| 7,337,687 | B2 * | 3/2008 | Okumoto | F02N 15/065 74/6 |
| 8,302,497 | B2 * | 11/2012 | Niimi | F02N 11/087 74/7 C |
| 2003/0136624 | A1 | 7/2003 | Kajino et al. | |
| 2010/0257975 | A1 | 10/2010 | Niimi et al. | |
| 2011/0308490 | A1 * | 12/2011 | Hartmann | F02N 15/063 123/179.4 |

FOREIGN PATENT DOCUMENTS

| | | | |
|---|---|---|---|
| JP | 2013-057325 | A | 3/2013 |
| JP | 2014-080942 | A | 5/2014 |
| JP | 5846250 | B2 | 1/2016 |

* cited by examiner

WHEN PUSHING OUT PINION GEAR

WHEN MOTOR ROTATES

WHEN PUSHING OUT PINION GEAR

WHEN MOTOR ROTATES

STARTER FOR INTERNAL COMBUSTION ENGINE

CROSS-REFERENCE TO RELATED APPLICATION

This application is based on and claims the benefit of priority from earlier Japanese Patent Application No. 2016-228660 filed Nov. 25, 2016, the description of which is incorporated herein by references.

TECHNICAL FIELD

The present disclosure relates to a starter for an internal combustion engine.

BACKGROUND

A so-called shift-type starter is known as a starter for an internal combustion engine.

A pinion gear engages with a ring gear by pushing out the pinion gear when starting the internal combustion engine in the starter.

In this case, since collision sound of the two gears is generated when the pinion gear engages with the ring gear, reduction of the collision sound becomes a problem.

As a technique for reducing the collision sound of the pinion gear with the ring gear in the starter, the technique disclosed in Japanese Patent No. 5846250, for example, is known.

Such a technique has an inner tube which holds a pinion gear in a relatively non-rotatable manner and slidably in an axial direction, and the pinion gear and the inner tube are provided respectively with a gear-side pressure-receiving surface in a pinion gear side and a tube-side pressure-receiving surface in an inner tube side which are opposed to each other at a predetermined interval in the axial direction, and a buffer member is disposed between the gear-side pressure-receiving surface and the tube-side pressure-receiving surface.

Then, the buffer member reduces the impact force when the pinion gear collides with the ring gear, thereby reducing collision noise.

The collision sound of the pinion gear against the ring gear is considered to depend on the moving speed of the pinion gear when the pinion gear collides with the ring gear.

In this respect, in the above-described conventional technique, although the impact force when the pinion gear collides with the ring gear is absorbed by the buffer member, if the moving speed of the pinion gear at the timing when the pinion gear collides is high, the effect of reducing the collision sound is considered to be small.

In order to reduce the collision noise of the pinion gear with respect to the ring gear, it is conceivable to reduce the extrusion speed of a pushing member (shift lever) pushed out by energizing an electromagnetic switch.

However, with such a configuration, for example, the moving speed of the pinion gear when disengaging the pinion gear from the ring gear will be delayed, and there is a concern that inconvenience may be caused due to the delay of disengagement of the pinion gear.

SUMMARY

An embodiment provides a starter for an internal combustion engine capable of appropriately reducing a collision noise of a pinion gear with respect to a ring gear Means for solving the above-mentioned problems, and operations and effects thereof will be described below.

In a starter for an internal combustion engine according to a first aspect, the starter includes a rotating shaft formed with a helical spline on an outer periphery thereof and which rotates by a rotation of a motor, a pinion gear helically splined to the rotating shaft and movable in an axial direction of the rotating shaft along a tooth surface of the helical spline, a receiving member disposed opposing an end surface in an axial direction of the pinion gear, moved by receiving an axial pushing force by a pushing member, and causing the pinion gear to engage with a ring gear of the internal combustion engine by a movement thereof, and a restricting part for restricting a movement of the pinion gear in a rotational direction when the pinion gear moves along the teeth surface of the helical spline.

When starting the internal combustion engine, the receiving member is moved under a pushing force in the axial direction by the pushing member, and the pinion gear is engaged with the ring gear by the movement.

At this time, the pinion gear moves along the teeth surface of the helical spline. That is, the pinion gear moves in the axial direction with rotation.

In the above configuration, in particular, since the rotation of the pinion gear is restricted by the restricting part, the movement in the axial direction of the pinion gear is restricted in accordance with a rotation restriction.

As a result, the moving speed of the pinion gear is restricted, and consequently the collision noise generated when the pinion gear collides with the ring gear can be reduced.

In the starter for the internal combustion engine according to a second aspect, the restricting part is disposed between the end face in the axial direction of the pinion gear and the receiving member, and restricts relative rotation between the pinion gear and the receiving member by a frictional force when the receiving member moves.

The end face in the axial direction of the pinion gear and the receiving member are disposed opposite to each other, and the receiving member is a member that moves in the axial direction under the axial pushing force of the pushing member, whereas the pinion gear is a member accompanied by rotation by a helical spline when moved by the push out of the receiving member.

In other words, although the pinion gear and the receiving member move integrally in the axial direction, the pinion gear receives a force in the rotational direction, while the receiving member receives no force in the rotational direction, so behaviors in the rotational direction are different from each other.

In this case, if a frictional force is generated between the two, it is possible to restrict the relative rotation between the pinion gear and the receiving member, thereby restricting the movement of the pinion gear in the rotational direction.

In this respect, in the above-described configuration, the restricting part is disposed between the end face in the axial direction of the pinion gear and the receiving member so that the relative rotation between the pinion gear and the receiving member is restricted by the frictional force generated at the restricting part when the receiving member moves.

Due to such restriction of the relative rotation, the movement of the pinion gear is reduced and eventually the moving speed of the pinion gear in the axial direction is restricted.

In the starter for the internal combustion engine according to a third aspect, a buffer member having elasticity is disposed as the restricting part between the end face in the axial direction of the pinion gear and the receiving member.

In a case where the restricting part is disposed between the end face in the axial direction of the pinion gear and the receiving member, the restricting part receives a pressing force in the axial direction when the receiving member moves by the pushing force of the pushing member, and when the movement is ended, the pressing force is released.

In this case, if the buffer member having elasticity is used as the restriction part, when the receiving member is moved, the buffer member is compressed, so that the frictional force increases and the relative rotation between the pinion gear and the receiving member is restricted.

Further, when the movement of the receiving member is completed, that is, when the engaging of the pinion gear is completed, the frictional force is reduced by decompression of the buffer member, thus the restriction of the relative rotation between the pinion gear and the receiving member is canceled.

By canceling the relative rotation restriction, it is possible to prevent the rotation of the pinion gear from being hindered when the motor rotates.

In short, according to the above configuration, the pinion gear is not suppressed from rotating when the motor rotates, and the pinion gear 13 is suppressed from rotating only when the pinion gear is pushed out, so that the moving speed of the pinion gear can be suppressed from increasing.

In the starter for the internal combustion engine according to a fourth aspect, the buffer member has a low friction surface on a side facing at least one of the end face in the axial direction of the pinion gear and an end face of the receiving member.

According to the above configuration, in the buffer member, at least one of the pinion gear side surface and the receiving member side surface is a low friction surface.

As a result, even if the buffer member is interposed between the pinion gear and the receiving member, slippage of the buffer member with respect to the pinion gear and the receiving member is liable to occur under an engaging state of the pinion gear due to the movement of the receiving member, and the relative rotation between the pinion gear and the receiving member can be restrained from being restricted.

Thereby, it is possible to preferably suppress the rotation of the pinion gear from being hindered when the motor rotates.

It should be noted that the buffer member may be composed of an elastic member having elasticity and a low friction member attached to an outer surface thereof and having a low friction surface on its outer surface.

In the starter for the internal combustion engine according to a fifth aspect, a contact area of the buffer member with at least one of the pinion gear and the receiving member is larger in a moving state in which the receiving member is moving than in a state where the buffer member is not moving.

According to the above configuration, a contact area of the buffer member with respect to the pinion gear and the receiving member varies according to whether the receiving member is moved or not moved by the pushing out of the pushing member.

In this case, the frictional force of the buffer member against the pinion gear and the receiving member can be increased by increasing the contact area when the receiving member is in the moving state.

Thereby, it becomes possible to restrict the relative rotation between the pinion gear and the receiving member during movement of the pinion gear and the receiving member.

Further, the frictional force of the buffer member against the pinion gear and the receiving member can be reduced by reducing the contact area in the non-moving state.

Thereby, it becomes possible to restrict the relative rotation restriction between the pinion gear and the receiving member when the pinion gear and the receiving member are not moving.

In the starter for the internal combustion engine according to a sixth aspect, a helical spline in the pinion gear side engaging with the helical spline in the rotating shaft side is formed at a radial center portion of the pinion gear, and a sliding resistance part, as the restricting part, serving as a resistance when the two helical splines slide relative to each other is provided on a teeth surface to which a force is transmitted by contact when pushing out the pinion gear in at least one of the spline in the rotating shaft side and the spline in the pinion gear side.

When the pinion gear and the receiving member are integrally moved by the pushing out of the pushing member, the pinion gear moves with rotation in a state in which the helical spline (female spline) on the pinion gear side is in contact with the teeth surface of the helical spline (male spline) on the rotating shaft side.

In this case, since the sliding resistance part is disposed on the teeth surface of at least one of the rotating shaft side and the pinion gear side, sliding resistance is imparted when the two helical splines slide relative to each other.

Then, the rotation of the pinion gear and the movement in the axial direction are restricted by the sliding resistance.

As a result, the moving speed of the pinion gear is restricted, and the collision sound generated when the pinion gear collides with the ring gear is reduced.

DETAILED DESCRIPTION OF THE PREFERRED EMBODIMENT

Figure 1:
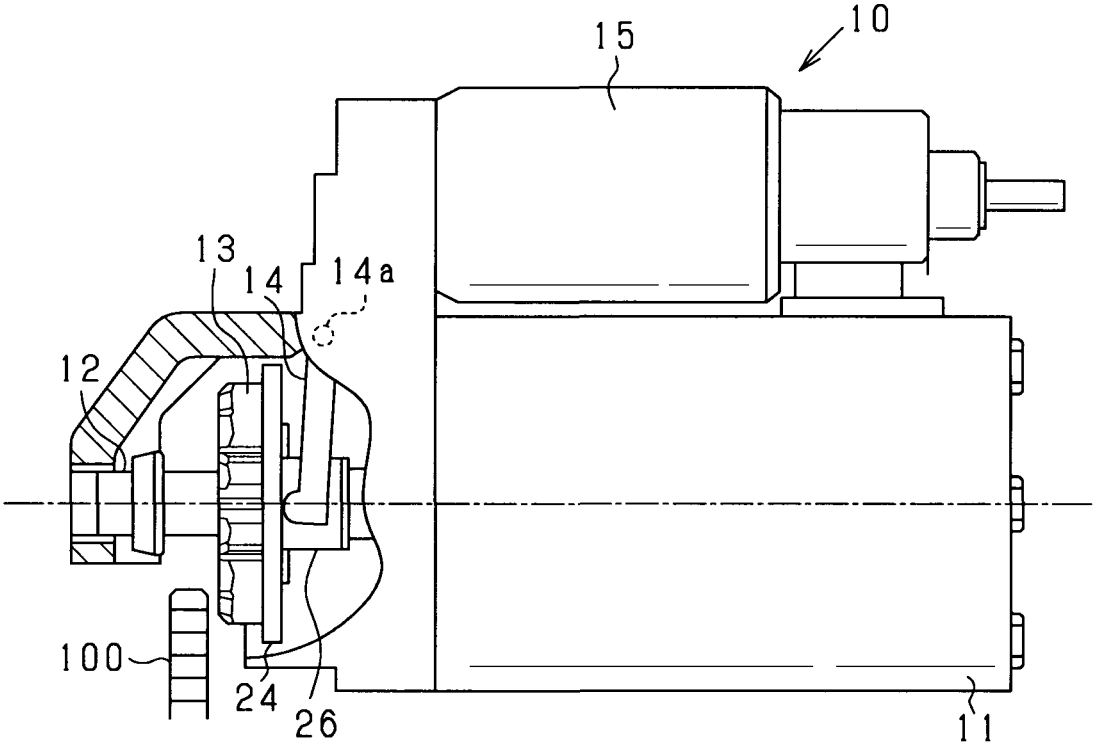
FIG. 1 shows a side view of a starter.

Hereinafter, a starter according to embodiments will be described with reference to the drawings.

In the following embodiments, the same or equivalent components are denoted by the same reference numerals in the drawings.

First Embodiment

FIG. 1 shows a side view of a starter 10 for an internal combustion engine (not shown), and a part thereof is shown as a sectional view.

The starter 10 is mounted on a vehicle such as an automobile, and is used for imparting an initial rotation to an engine when starting the engine (internal combustion engine).

The starter 10 includes a motor 11 that generates a rotational force by energization, a rotating shaft 12 that is rotated by the motor 11, a pinion gear 13 that is movably attached to the rotating shaft 12 and is engaged with a ring gear 100 of the engine, a shift lever 14 that pushes the pinion gear 13 toward a side opposite to the motor 11 (the left side in FIG. 1) in an axial direction of the rotating shaft 12, and an electromagnetic switch 15 that rotates the shift lever 14.

It should be noted that in the present embodiment, for convenience, the axial direction of the rotating shaft 12, that is, the left-right direction in FIG. 1 is also simply referred to as an axial direction. In addition, the shift lever 14 corresponds to a pushing member.

The starter 10 of the present embodiment is a so-called shift-type starter.

When the electromagnetic switch 15 is energized in accordance with a start request of the starter 10, the pinion gear 13 is pushed out to a distal end side (to the left side in FIG. 1) of the rotating shaft 12 by an operation of the shift lever 14.

At this time, the shift lever 14 rotates around a fulcrum portion 14*a*.

As the shift lever 14 pushes out the pinion gear 13, the pinion gear 13 engages with the ring gear 100.

Further, in response to the movement of the pinion gear 13, energization to the motor 11 is started, and the motor 11 rotates.

The rotation of the motor 11 causes the pinion gear 13 to rotate together with the rotating shaft 12, so that the rotation of the pinion gear 13 is transmitted to the ring gear 100, eventually starting the engine.

In the present embodiment, as an electrical configuration relating to a pushing-out drive of the pinion gear 13 and a rotational driving of the motor 11, this configuration has the rotation of the motor 11 subordinate to the pushing-out drive of the pinion gear 13, that is, the pinion gear 13 is driven first and then the motor 11 is driven to rotate.

However, the pushing-out drive of the pinion gear 13 and the rotational driving of the motor 11 may be separately carried out.

Next, a configuration of a principal part of the starter 10 in the present embodiment will be described in detail.

Figure 2:
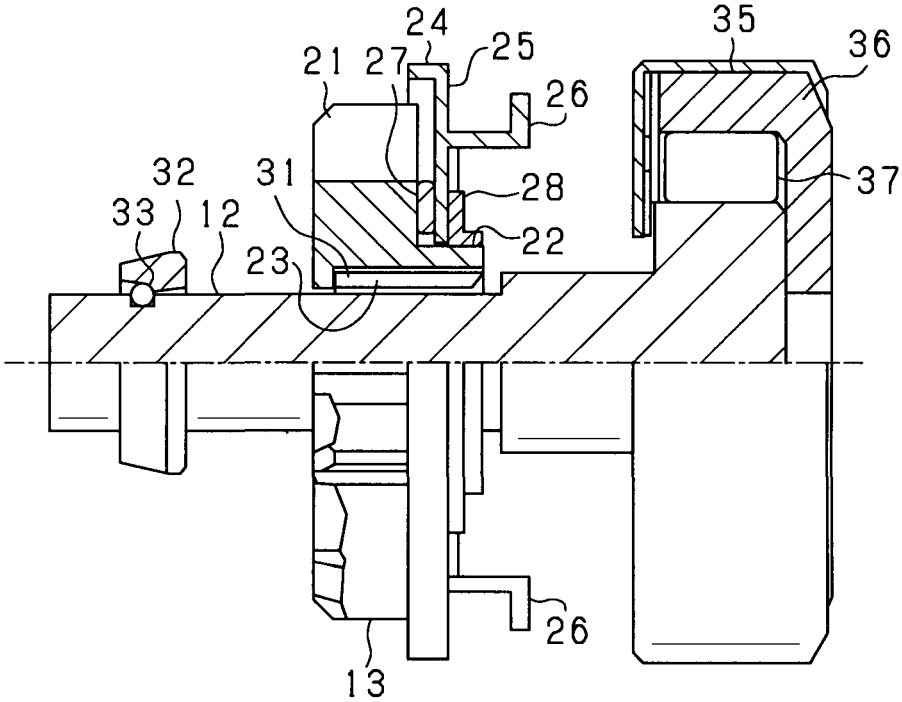
FIG. 2 shows a half sectional view of a principal part of the starter.
Figure 3:
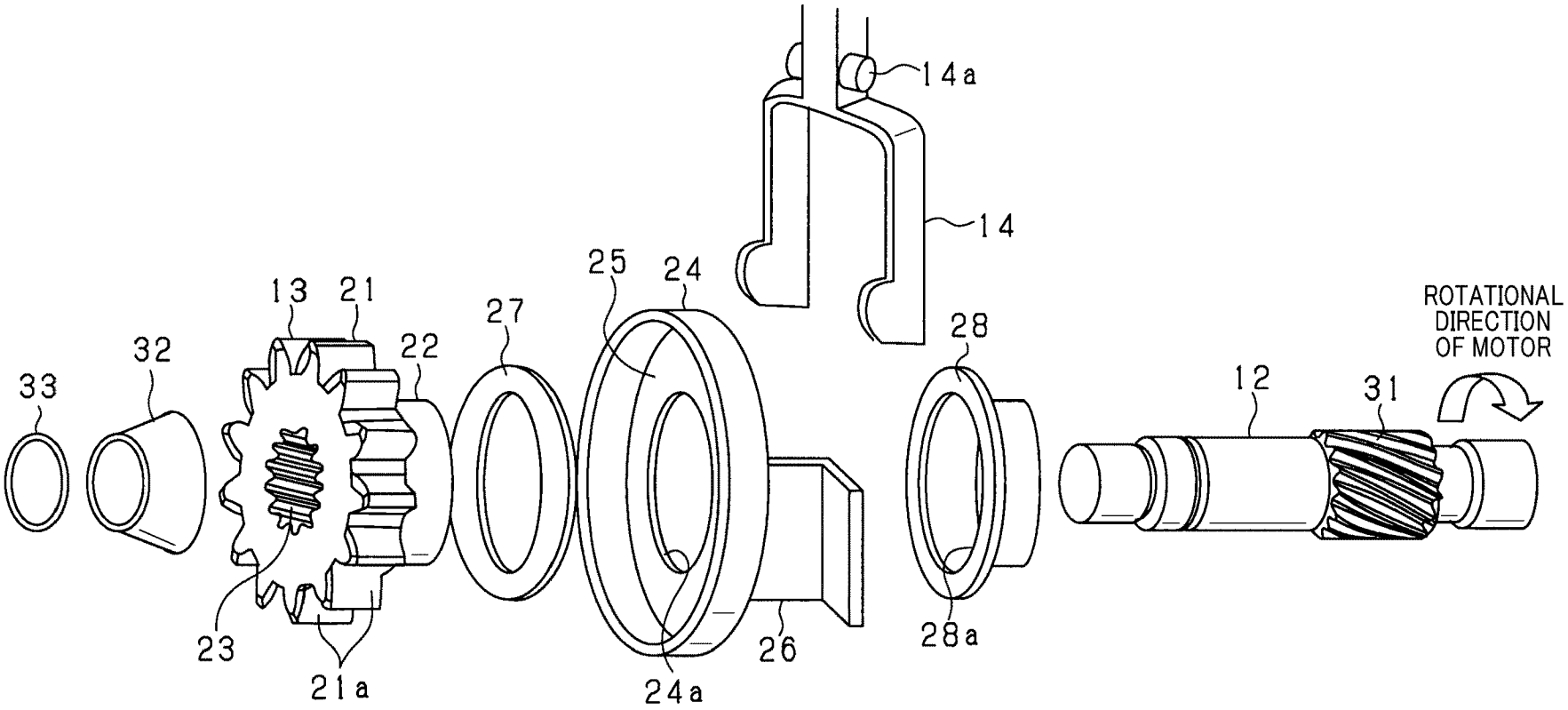
FIG. 3 shows an exploded perspective view of the principal part of the starter.

As shown in FIGS. 2 and 3, the pinion gear 13 has a gear portion 21 provided with a plurality of gear teeth 21*a* and a columnar boss portion 22 disposed on the motor 11 side of the gear portion 21.

The pinion gear 13 has a hollow portion extending in the axial direction, and a helical spline 23 is formed on an inner peripheral surface side (radial center portion) of the hollow portion.

A lever receiving member 24 is attached to the pinion gear 13 on the motor 11 side in the axial direction, engaged with a distal end of the shift lever 14, and the pinion gear 13 is axially moved in accordance with the rotational movement of the distal end of the shift lever 14.

That is, the lever receiving member 24 is disposed so as to oppose an end surface in the axial direction of the pinion gear 13, and moves in response to the pushing force in the axial direction by the shift lever 14.

The lever receiving member 24 is formed of, for example, a synthetic resin material, and includes a disk-shaped opposing portion 25 opposing a motor side end surface of the pinion gear 13 and a pair of lever engaging portions 26 disposed on a side opposite to the pinion (motor side) of the opposing portion 25.

A hole portion 25*a* through which the boss portion 22 of the pinion gear 13 is inserted is formed in the opposing portion 25.

When pushing out the pinion gear 13, the shift lever 14 pivots about the fulcrum portion 14*a* in the clockwise direction in FIG. 1, and accordingly the opposing portion 25 of the lever receiving member 24 is pushed by the distal end of the lever 14.

As a result, the lever receiving member 24 moves to the left in the axial direction, and accordingly the pinion gear 13 moves to the left in the axial direction (that is, toward the ring gear 100).

That is, as the lever receiving member 24 moves, the pinion gear 13 engages with the ring gear 100.

In addition, when the pinion gear 13 is pulled back afterwards, the shift lever 14 pivots in the counterclockwise direction in FIG. 1, so that the lever engaging portions 26 of the lever receiving member 24 are pushed by the distal end of the lever 14.

Thereby, the pinion gear 13 is disengaged from the ring gear 100.

A ring-shaped buffer member 27 is disposed between the gear portion 21 of the pinion gear 13 and the opposing portion 25 of the lever receiving member 24.

The buffer member 27 is formed of an elastic material such as rubber, for example, and is disposed in a state in which the boss portion 22 of the pinion gear 13 is inserted.

The buffer member 27 corresponds to a restricting part, details of which will be described later.

A fixing member 28 for fixing the lever receiving member 24 to the pinion gear 13 is assembled to the boss portion 22 of the pinion gear 13.

The fixing member 28 has a hole portion 28*a* through which the boss portion 22 of the pinion gear 13 is inserted, and in a state where the buffer member 27 and the lever receiving member 24 are integrated, they are assembled to the boss portion 22 in order to be fixed.

As shown in FIG. 2, in an assembled state of the fixing member 28, the buffer member 27 is interposed between the gear portion 21 of the pinion gear 13 and the opposing portion 25 of the lever receiving member 24 while being sandwiched therebetween, and the buffer member 27 is in contact with both the pinion gear 13 and the lever receiving member 24.

However, in the assembled state of the fixing member 28, the buffer member 27 may be in non-contact with at least one of the pinion gear 13 and the lever receiving member 24.

The buffer member 27, the lever receiving member 24 and the fixing member 28 are integrally assembled to the pinion gear 13, and an integral body thereof is attached to the rotating shaft 12.

In this case, a helical spline 31 (male spline) is formed on an outer peripheral portion of the rotating shaft 12, and the helical spline 23 of the pinion gear 13 side is fitted to the helical spline 31 of the rotating shaft 12.

As a result, the pinion gear 13 is helically splined to the rotating shaft 12.

The helical spline 23 in the pinion gear 13 side is a female spline and the helical spline 31 in the rotating shaft 12 side is a male spline.

A detaching prevention member 32 for preventing the pinion gears 13 and the like from detaching from the rotation shaft 12 is attached to a distal end portion of the rotation shaft 12 in a state where the integral body made of the pinion gear 13 and the like is assembled.

The detaching prevention member 32 is a member for preventing the pinion gear 13 from detaching from the rotation shaft 12 when the pinion gear 13 is pushed out in the axial direction, and is disposed to be separated from the pinion gear 13 in an initial state in which the pinion gear 13 is not pushed out position.

A ring member 33 is fitted to an inner peripheral side of the detaching prevention member 32.

In addition, an over running clutch 35 is attached to the rotating shaft 12.

As is well known, the overrunning clutch 35 is a clutch (one-way clutch) for preventing the motor 11 from breaking due to overrun when an engine speed rises, and includes an outer 36, a clutch roller 37, a spring (not shown), and the like.

In the configuration in which the pinion gear 13 is helically splined to the rotating shaft 12 as described above, when the pinion gear 13 moves together with the lever receiving member 24 in accordance with the rotation of the shift lever 14, the pinion gear 13 moves in the axial direction along teeth surfaces of the spline 31 of the rotating shaft 12.

That is, the pinion gear 13 moves along the rotating shaft 12 with a rotation in accordance with a twisting angle of the helical spline 31.

Here, a transmission of force at the rotation shaft 12 and the pinion gear 13 will be described.

Figure 4A:
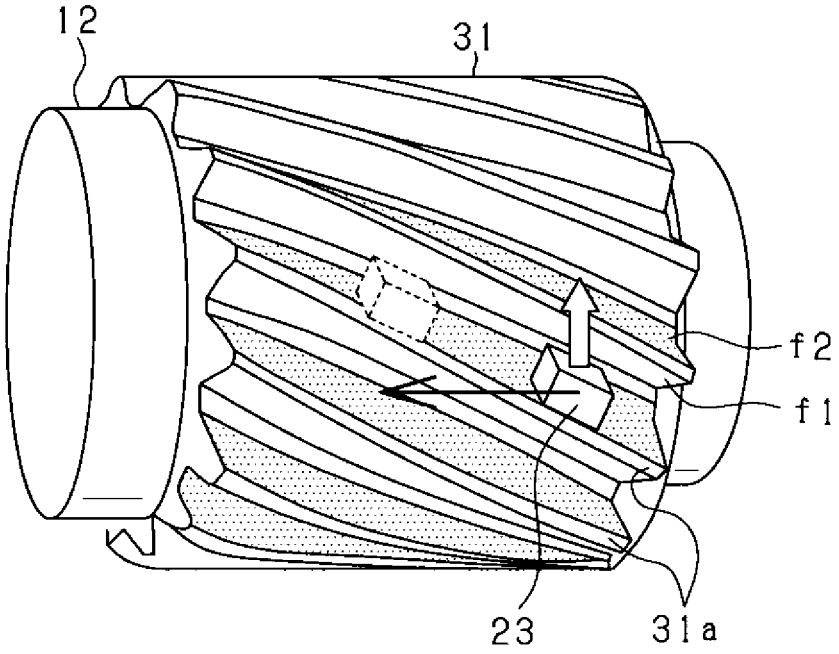
FIG. 4A shows a perspective view of a helical spline for explaining a transmission of force between a rotating shaft side and a pinion gear side when pushing out the pinion gear.
Figure 4B:
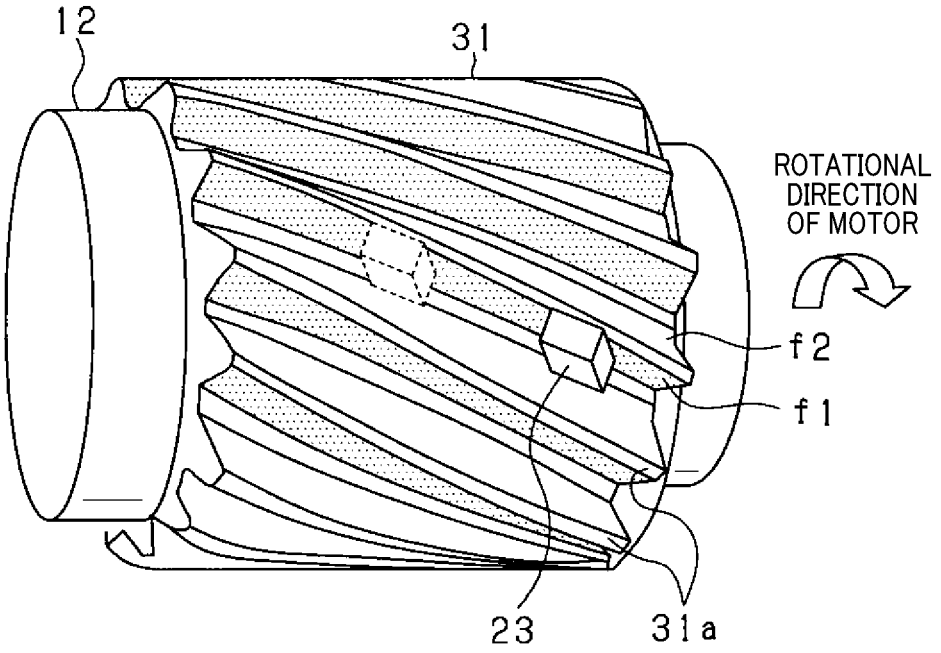
FIG. 4B shows a perspective view of the helical spline for explaining the transmission of force between the rotating shaft side and the pinion gear side when the motor is rotated.

FIGS. 4A and 4B are diagrams showing the transmission of force between the rotating shaft 12 and the pinion gear 13 when the pinion gear is pushed out and when the motor is rotated, respectively.

Note that force transmission surfaces of the spline teeth 31*a* in the helical spline 31 are different between when the pinion gear is pushed out and when the motor is rotated, and in FIG. 4, dots are given to the force transmission surfaces of the spline teeth 31*a* for the sake of convenience.

Assuming the rotational driving of the motor 11, among two teeth surfaces f1 and f2 of the each spline tooth 31*a*, the teeth surface f1 is a driving surface and the teeth surface f2 is a non-driving surface.

In FIG. 4A, the teeth surface f2 serves as a force transmission surface, and in FIG. 4B, the teeth surfaces f1 serves as a force transmission surface.

In addition, a part of the helical spline 23 of the pinion gear 13 in a state of engaging with the spline teeth 31*a* is show in FIGS. 4A and 4B.

When the pinion gear 13 is to be pushed out as shown in FIG. 4A, the rotation of the rotating shaft 12 is stopped, and when the pinion gear 13 is pushed out toward a side opposite to the motor 11 (the left side in the drawing), the helical spline 23 of the pinion gear 13 is pressed against the teeth surface f2 (non-driving surface) of the teeth 31*a* of the helical spline 31.

Then, the helical spline 23 of the pinion gear 13 moves along the teeth surfaces f2 of the spline teeth 31*a*.

In this case, the pinion gear 13 moves in the axial direction with rotation.

When the motor rotates as shown in FIG. 4B, the teeth surfaces f1 (driving surface) of the teeth 31*a* of the helical spline 31 is pressed against the helical spline 23 of the pinion gear 13 as the motor 11 rotates.

In this case, the pinion gear 13 rotates with the rotation of the motor 11 while receiving a force from the teeth surfaces f1 toward the side opposite to the motor 11 (the ring gear 100 side, the left side in the drawing).

That is, it can be said that the helical spline 31 has such a shape as to move the pinion gear 13 toward the side opposite to the motor 11 during the engine starting rotation.

In the present embodiment, in order to suppress a collision noise between the pinion gear 13 and the ring gear 100 from being generated during a pushing out of the pinion gear 13 when the pinion gear 13 moves along the teeth surfaces of the helical spline 31, the buffer member 27 restricts a movement of the pinion gear 13 in a rotating direction.

The following will describe an example of collision sound suppression.

As described above, the buffer member 27 as the restricting part is disposed between the end surface in the axial direction of the pinion gear 13 and the lever receiving member 24.

The buffer member 27 is made of an elastic body.

The buffer member 27 restricts relative rotation between the pinion gear 13 and the lever receiving member 24 by a frictional force when the lever receiving member 24 moves.

When the engine is started, the lever receiving member 24 moves in response to an axial pushing force of the shift lever 14, and the pinion gear 13 engages with the ring gear 100 by the movement.

At this time, the lever receiving member 24 moves in the axial direction by the pushing force of the shift lever 14, whereas the pinion gear 13 moves in the axial direction along the teeth surfaces f2 (non-driving surface) of the helical spline 31 of the rotating shaft 12 with a rotation (refer to FIG. 4A).

In other words, although the pinion gear 13 and the lever receiving member 24 move integrally in the axial direction, the pinion gear 13 receives a force in the rotational direction, while the lever receiving member 24 receives no force in the rotational direction, so behaviors in the rotational direction are different from each other.

However, since the buffer member 27 made of an elastic body is disposed between the pinion gear 13 and the lever receiving member 24 in the present embodiment, the rotation of the pinion gear 13 is restricted by the buffer member 27, and with the restriction of the rotation, the movement of the pinion gear 13 in the axial direction is restricted.

More specifically, since the buffer member 27 is compressed between the pinion gear 13 and the lever receiving member 24 when the lever receiving member 24 moves, a relative rotation between the pinion gear 13 and the lever receiving member 24 is restricted due to the frictional force in the compressed state.

That is, the lever receiving member 24 is pushed out in the axial direction as the shift lever 14 pivots about the fulcrum portion 14*a*.

At this time, the pinion gear 13 receives an axial force in a direction opposite to the pushing direction by the shift lever 14 in accordance with the angle of the helical spline.

Therefore, the buffer member 27 between the pinion gear 13 and the lever receiving member 24 receives an axial compression force, and the frictional force at an interface increases.

Since the rotation of the lever receiving member 24 is restricted, the rotation of the pinion gear 13 attached with the buffer member 27 interposed therebetween is also restricted.

Due to the restriction of the relative rotation, the movement of the pinion gear 13 in the axial direction is reduced and, in turn, the moving speed of the pinion gear 13 in the axial direction is limited.

In other words, the moving speed in the axial direction of the pinion gear 13, which is conventionally determined by the teeth surfaces f2 (non-driving surface) of the helical spline 31 of the rotating shaft 12, the surface of the helical spline 23 of the pinion gear 13, and the pushing force in the axial direction by the shift lever 14, is adjusted in accordance with the mode of the buffer member 27.

Therefore, the moving speed in the axial direction can be adjusted according to the use environment.

Considering that the buffer member 27 is an elastic body in particular, a compressibility of the buffer member 27 increases as the lever receiving member 24 moves due to the pushing out of the shift lever 14, and a compression load increases accordingly.

Figure 5:
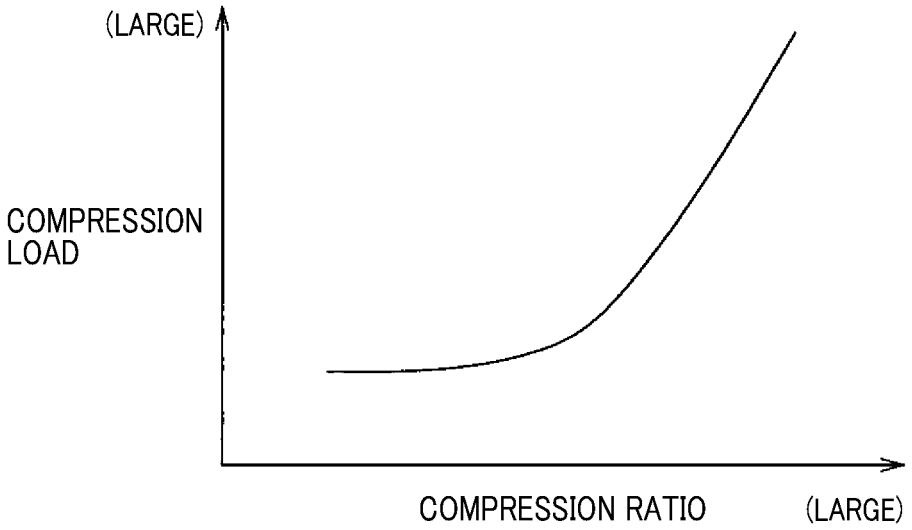
FIG. 5 shows a graph showing a relationship between compression ratio and compression load.

FIG. 5 shows a relationship between a compression ratio and the compression load.

In this case, the frictional force with respect to the pinion gear 13 and the lever receiving member 24, which are contacting partners of the buffer member 27, increases in proportion to the compression load.

Therefore, when the compression load of the buffer member 27 increases by pressing the lever receiving member 24 against the pinion gear 13, the frictional force increases, and the relative rotation between the pinion gear 13 and the lever receiving member 24 is restricted by the frictional force.

Then, the moving speed of the pinion gear 13 is restricted by the relative rotation between the pinion gear 13 and the lever receiving member 24, so that the collision sound generated when the pinion gear 13 collides with the ring gear 100 is reduced.

After the pushing out of the pinion gear 13 is completed, that is, after the engagement with the ring gear 100 is completed, the rotation of the pinion gear 13 by the rotation of the motor 11, that is, the engine is started.

At this time, when the rotating shaft 12 rotates, the pinion gear 13 is rotated by being pushed by the teeth surface f1 (driving surface) of the helical spline 31.

In this rotating state, a force is generated on the pinion gear 13 together with the rotational force in the axial direction toward the ring gear 100, so that the pinion gear 13 moves in the axial direction toward the ring gear 100.

As a result, the compression of the buffer member 27 is weakened between the pinion gear 13 and the lever receiving member 24 (that is, elastic deformation of the buffer member 27 is alleviated), and the frictional force generated on an outer surface of the buffer member 27 is reduced.

By the reduction of the frictional force, the restriction of the relative rotation between the pinion gear 13 and the lever receiving member 24 is weakened.

In other words, the relative rotation between the pinion gear 13 and the lever receiving member 24 becomes permitted.

Therefore, the motor rotational force is transmitted to the pinion gear 13 without loss, and the staring of the engine is suitably performed.

In order to transmit the rotational force of the motor to the pinion gear 13 without loss when the motor is rotating, it is desirable not to generate frictional force by the buffer member 27 as much as possible during rotation of the motor.

Therefore, in the buffer member 27, a side facing at least one of the end surface in the axial direction of the pinion gear 13 (specifically, the end surface of the gear portion 21) and the end surface of the lever receiving member 24 is set as a low friction surface in the present embodiment.

As a result, even if the buffer member 27 is interposed between the pinion gear 13 and the lever receiving member 24, slippage of the buffer member 27 with respect to the pinion gear 13 and the lever receiving member 24 is liable to occur under an engaging state of the pinion gear 13 due to the movement of the lever receiving member 24, and the relative rotation between the pinion gear 13 and the lever receiving member 24 can be restrained from being restricted.

For example, in comparison with the end surface of the pinion gear 13 in the axial direction and the end surface of the lever receiving member 24 with which the buffer member 27 contacts, it is preferable that the surface of the buffer member 27 be a low friction surface.

As a structure for disposing a low friction surface on the surface of the buffer member 27, it is conceivable that the buffer member 27 made of an elastic body may be processed to reduce the surface roughness.

Further, it is conceivable that the buffer member 27 may be composed of an elastic member having elasticity and a low friction member attached to an outer surface thereof having a low friction surface on its outer surface.

Figure 6:
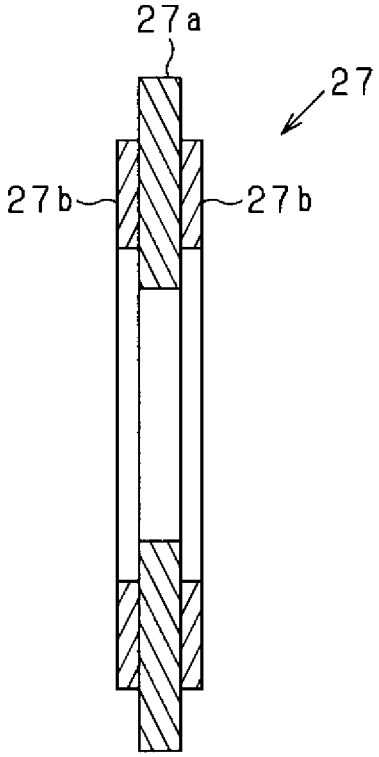
FIG. 6 shows a sectional view of a buffer member.

In this case, as shown in FIG. 6, the buffer member 27 is preferably composed of an elastic body 27*a* and low friction sheets 27*b* having a surface friction coefficient lower than that of the elastic body 27*a* disposed on both side surfaces thereof.

For example, the low friction sheets 27*b* may be adhered to the side surfaces of the elastic body 27*a*.

It should be noted that the low friction sheet 27*b* may be disposed on at least one of both side surfaces of the elastic body 27*a*.

Further, the buffer member 27 may have the following structure.

That is, in a moving state in which the lever receiving member 24 moves, the buffer member 27 has a larger contact area with respect to at least one of the pinion gear 13 and the lever receiving member 24, as compared with a state in which the lever receiving member 24 is not moving.

Figure 7A:
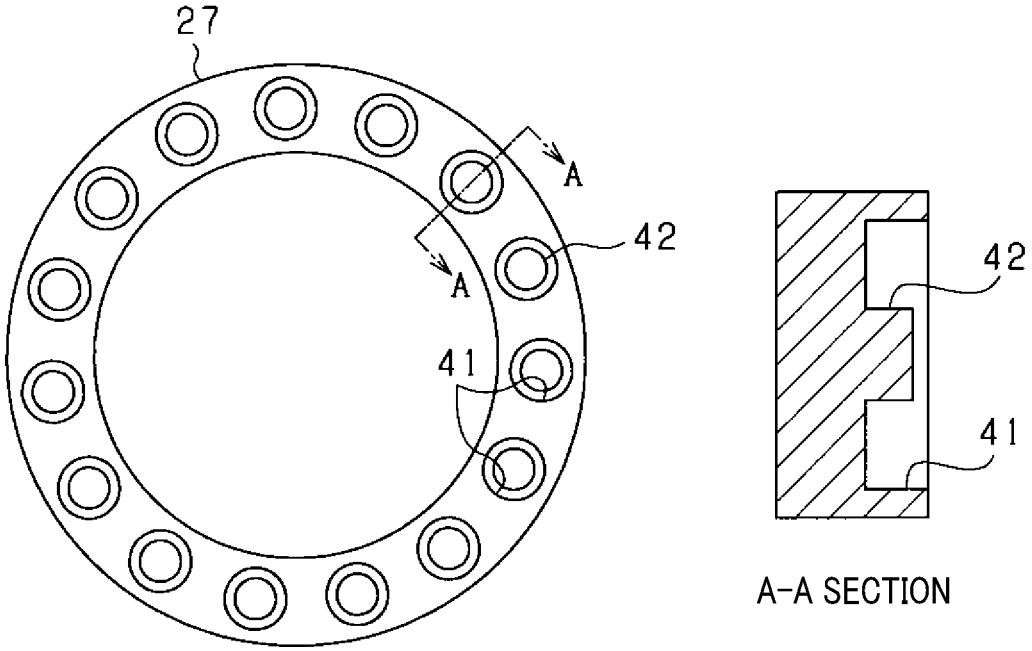
FIG. 7A shows a front view of the buffer member.
Figure 7B:
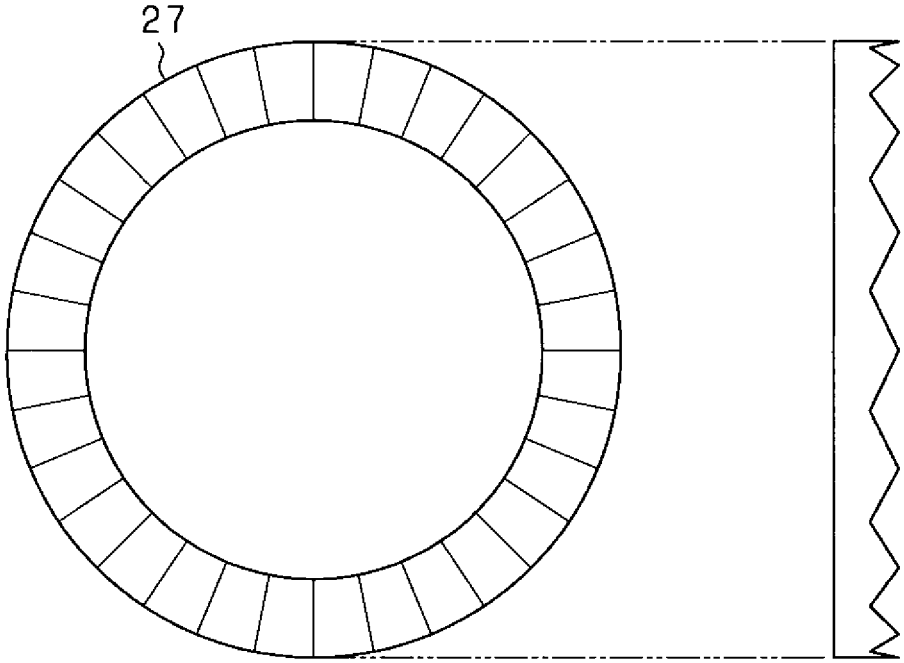
FIG. 7B shows a front view of another buffer member.

For example, the configurations shown in FIGS. 7A and 7B are conceivable.

In FIG. 7A, a plurality of concave portions 41 are disposed on a side surface of the buffer member 27 so as to be aligned in a circumferential direction.

Each of the concave portions 41 has a circular shape, and a central portion thereof is a projection 42.

In this case, when the buffer member 27 is compressed between the pinion gear 13 and the lever receiving member 24, inner and outer portions of the concave portions 41 are elastically deformed (crushed deformation), and when the compression is released, the elastic deformation returns.

In an elastically deformed state, a contact area of the buffer member 27 with respect to the pinion gear 13 and the lever receiving member 24 is larger than in a state in which the buffer member 27 is not elastically deformed.

It should be noted that a shape of the concave portion 41 may be arbitrary. In addition, a cylindrical convex portion (projection) may be disposed.

The concave portions 41 may be disposed on either the pinion gear 13 side or the lever receiving member 24 side, or may be disposed on both sides.

Further, as shown in FIG. 7B, irregularities are formed on a side surface of the buffer member 27 so as to be continuous in a circumferential direction.

It should be noted that a shape of the irregularities may be arbitrary, and may be formed in any one of a sine wave shape, a rectangular wave shape, and a saw teeth wave shape, in addition to being formed in a triangular wave shape.

In this case, when the buffer member 27 is compressed between the pinion gear 13 and the lever receiving member 24, protrusions of the irregularities are elastically deformed (crushed deformation), and when the compression is released, the elastic deformation returns.

In an elastically deformed state, a contact area of the buffer member 27 with respect to the pinion gear 13 and the lever receiving member 24 is larger than in a state in which the buffer member 27 is not elastically deformed.

It should be noted that the irregularities may be disposed on either the pinion gear 13 side or the lever receiving member 24 side, or may be disposed on both sides.

The following excellent effects can be obtained according to the present embodiment described in detail above.

In the starter 10, the buffer member 27 is disposed as a restricting part for restricting the movement of the pinion gear 13 in the rotational direction when the pinion gear 13 moves along the teeth surfaces of the helical spline 31 of the rotating shaft 12.

In this case, the axial movement of the pinion gear 13 is restricted by rotation restriction of the pinion gear 13 by the buffer member 27.

As a result, the moving speed of the pinion gear 13 is restricted, and consequently the collision noise generated when the pinion gear 13 collides with the ring gear 100 can be reduced.

When the frictional force is generated between the pinion gear 13 and the lever receiving member 24 which face each other in the axial direction, it is possible to restrict the relative rotation between the pinion gear 13 and the lever receiving member 24 so that the movement of the pinion gear 13 in the rotational direction can be restricted.

In this respect, in the above configuration, the relative rotation between the pinion gear 13 and the lever receiving member 24 is restricted by the frictional force generated in the buffer member 27 between the end face in the axial direction of the pinion gear 13 and the lever receiving member 24.

Due to the restriction of the relative rotation, the movement of the pinion gear 13 is reduced and eventually the moving speed of the pinion gear 13 in the axial direction is restricted.

As a restricting part, the buffer member 27 having elasticity is disposed.

In this case, when the lever receiving member 24 is moved, the buffer member 27 is compressed so that the frictional force is increased and relative rotation between the pinion gear 13 and the lever receiving member 24 is restricted.

Further, when the movement of the lever receiving member 24 is completed, that is, when the engaging of the pinion gear 13 is completed, the frictional force is reduced by decompression of the buffer member 27, thus the restriction of the relative rotation between the pinion gear 13 and the lever receiving member 24 is canceled.

By canceling the relative rotation restriction, it is possible to restrain the rotation of the pinion gear 13 from being hindered when the motor 11 rotates.

In short, according to the above configuration, the pinion gear 13 is not suppressed from rotating when the motor rotates, and the pinion gear 13 is suppressed from rotating only when the pinion gear is pushed out, so that the moving speed of the pinion gear 13 can be suppressed from increasing.

In the buffer member 27, at least one of the surface on the side of the pinion gear 13 and the surface on the side of the lever receiving member 24 is a low friction surface.

As a result, even when the buffer member 27 is interposed between the pinion gear 13 and the lever receiving member 24 in a contacting state, and when the pinion gear 13 is under the engaging state by the movement of the lever receiving member 24, the relative rotation between the pinion gear 13 and the lever receiving member 24 can be restrained from being restricted.

Therefore, it is possible to suitably suppress the rotation of the pinion gear 13 from being inhibited during the rotation of the motor 11.

It is assumed that the contact area of the buffer member 27 with respect to at least one of the pinion gear 13 and the lever receiving member 24 is larger than that in the non-moving state when the lever receiving member 24 is in a moving state.

In this case, by increasing the contact area of the lever receiving member 24 in the moving state, the frictional force of the buffer member 27 against the pinion gear 13 and the lever receiving member 24 can be increased.

As a result, the relative rotation between the pinion gear 13 and the lever receiving member 24 can be restricted when the pinion gear 13 and the lever receiving member 24 move (that is, when the pinion gear 13 is pushed out).

Further, by reducing the contact area in the non-moving state, the frictional force of the buffer member 27 against the pinion gear 13 and the lever receiving member 24 can be reduced.

As a result, it is possible to suppress the relative rotation between the pinion gear 13 and the lever receiving member 24 from being restricted when the pinion gear 13 and the lever receiving member 24 are not moving (that is, after engaging of the pinion gear 13).

The starter 10 of the present embodiment is configured to separate the pinion gear 13 and the overrunning clutch 35 and push and move the pinion gear 13 separately from the overrunning clutch 35 (refer to FIG. 2).

In this case, the pinion gear 13 is lighter in weight than a case where the pinion gear 13 is pushed and moved integrally with the clutch, so that the moving speed when pushing out the pinion gear increases, and there is concern that the collision sound increases with it.

Even with such a configuration, as described above, by limiting the rotation of the pinion gear 13, it is possible to limit the moving speed of the pinion gear 13, and consequently to reduce the collision sound when the pinion gear 13 collides with the ring gear 100.

Second Embodiment

A second embodiment is constituted such that a sliding resistance part as a restricting part for restricting a movement of a pinion gear 13 in a rotational direction when the pinion gear 13 moves in an axial direction is disposed on a teeth surfaces, to which a force is transmitted when the pinion gear 13 is pushed out and contacted, of at least one of a helical spline 31 on a rotating shaft 12 side and a helical spline 23 on the pinion gear 13 side. The sliding resistance part serves as a resistance when both the helical splines 31 and 23 slide relative to each other.

In the present embodiment, the configuration described above is used as it is except for a configuration of the helical spline portions, and the function of restricting the rotation of the pinion gear 13 by the buffer member 27 is also provided.

However, the function of restricting the rotation of the pinion gear 13 by the buffer member 27 may optionally not be provided.

Figure 8A:
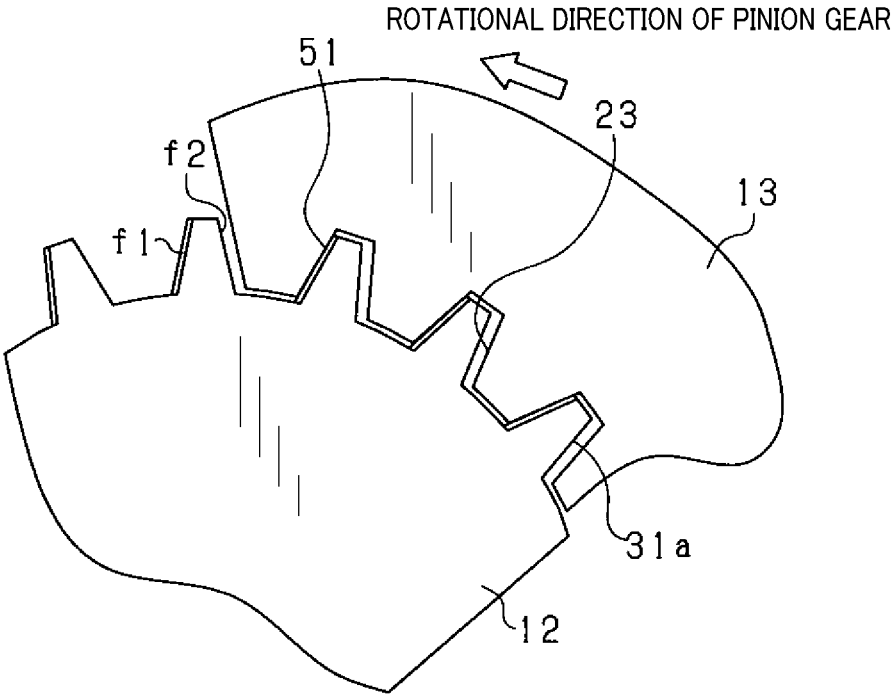
FIG. 8A shows a view for explaining a helical spline coupling part between a rotation shaft and a pinion gear when pushing out the pinion gear in a second embodiment.
Figure 8B:
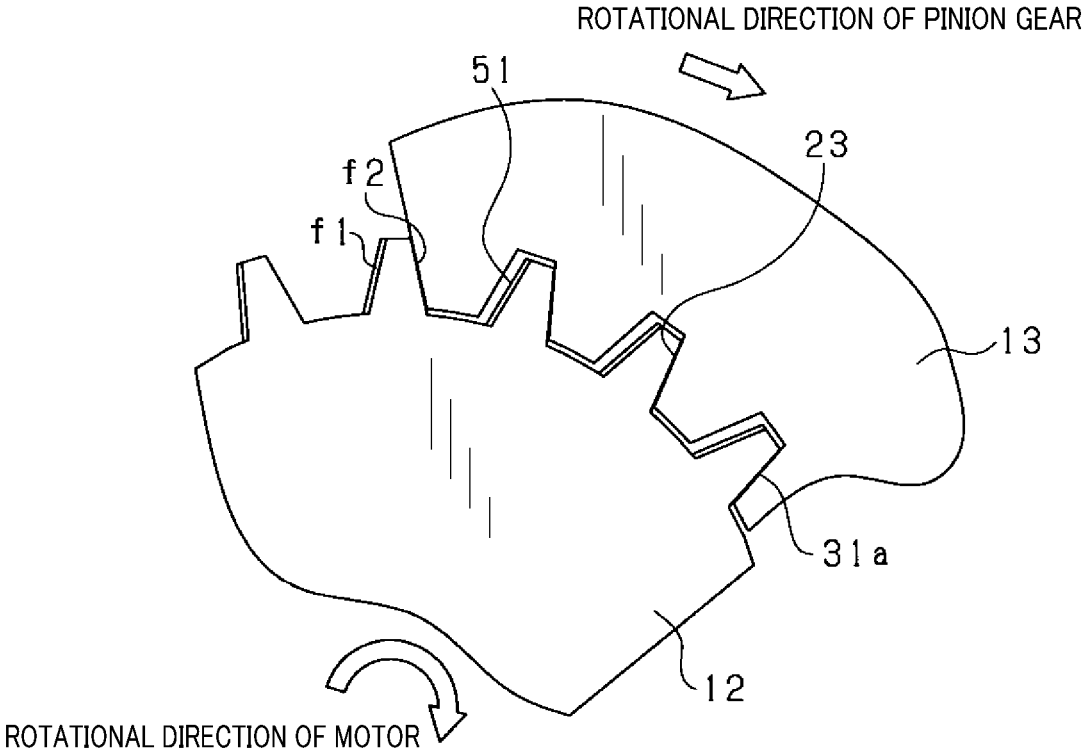
FIG. 8B shows a view for explaining the helical spline coupling part between the rotation shaft and the pinion gear when the motor is rotated in the second embodiment.

FIGS. 8A and 8B are sectional views each showing a helical spline coupling part between the rotating shaft 12 and the pinion gear 13. FIG. 8A shows a case when the pinion gear is pushed out and FIG. 8B shows a case when the motor rotates.

As described with reference to FIG. 4, a teeth surface f1 is a driving surface and a teeth surface f2 is a non-driving surface in a spline tooth 31*a* of the helical spline 31 on the rotating shaft 12 side.

When the pinion gear is pushed out as shown in FIG. 8A, the helical spline 23 of the pinion gear 13 side is pressed against the teeth surface f2 (non-driving surface) of the spline teeth 31*a* of the helical spline 31.

In this case, the pinion gear 13 moves in the axial direction with rotation as the helical spline 23 of the pinion gear 13 side slides against the teeth surface f2 (non-driving surface) of the spline teeth 31*a* of the helical spline 31.

In the present embodiment, a sliding resistance part 51 is disposed on the teeth surface f2 (non-driving surface) which is the sliding surface with the pinion gear 13 side at each spline tooth 31*a* of the helical spline 31.

Since the sliding resistance part 51 is disposed on each teeth surface f2 of the helical spline 31, sliding resistance is imparted when the two helical splines 23 and 31 slide relative to each other.

Then, due to the sliding resistance, the rotation of the pinion gear 13 and the movement in the axial direction are restricted.

As a result, the moving speed of the pinion gear 13 is restricted, and consequently the collision noise generated when the pinion gear 13 collides with the ring gear 100 can be reduced.

Any configuration can be applied to the sliding resistance part 51 as long as the sliding resistance part 51 can impart sliding resistance to the teeth surface f2 of the helical spline 31.

Figure 9A:
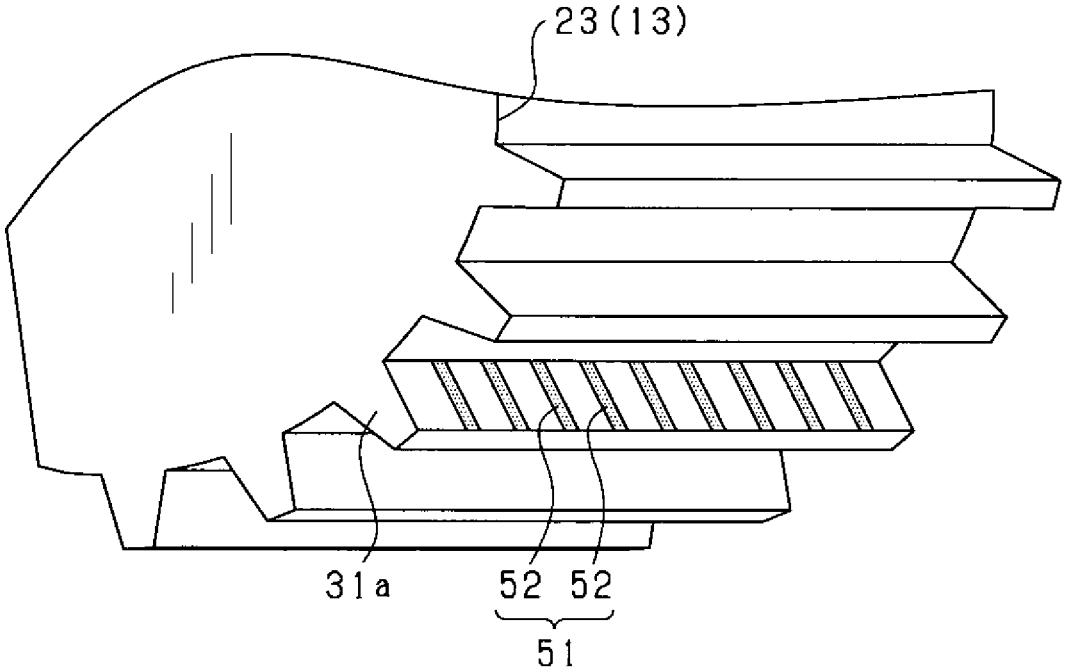
FIG. 9A shows a perspective view of a sliding resistance part in the second embodiment.

In a configuration shown in FIG. 9A, for example, a plurality of rough surface portions 52 having rough surface roughness are disposed so as to align in a direction in which the spline teeth 31*a* extend, and the sliding resistance parts 51 are formed by the plurality of rough surface portions 52.

Figure 9B:
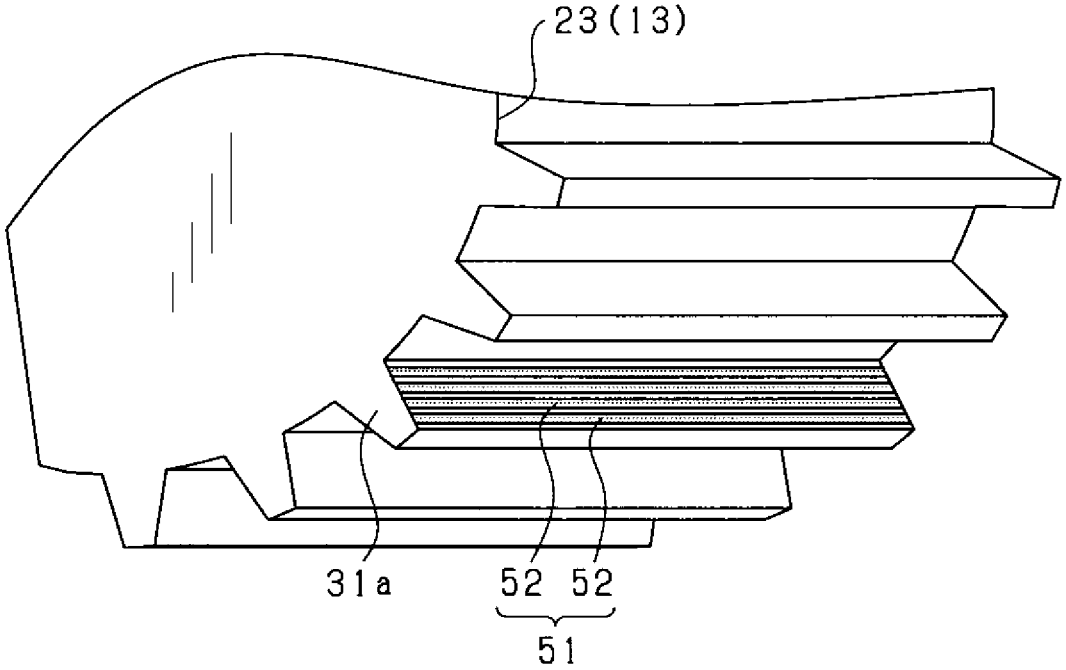
FIG. 9B shows a perspective view of another sliding resistance part in the second embodiment.

Further, in the configuration shown in FIG. 9B, a plurality of rough surface portions 52 are disposed so as to align in a height direction of the spline teeth 31*a*, and the sliding resistance parts 51 are formed by the plurality of rough surface portions 52.

In FIGS. 9A and 9B, although the plurality of rough surface portions 52 are disposed at equal intervals, the intervals may not be equal.

It is also possible to make the entire teeth surface f2 (non-driving surface) of the spline teeth 31*a* be the sliding resistance part 51.

In addition, the sliding resistance can be imparted by applying plating, painting, shot blasting or the like, or by forming grooves to the teeth surfaces f2 of the spline teeth 31*a*.

Other members such as a synthetic resin, an elastic body, or the like may be used as a sliding resistance part 51, and attach them to the teeth surfaces f2 by coating, pasting or the like.

The sliding resistance part 51 may be disposed on at least one of the helical spline 31 on the rotating shaft 12 side and the helical spline 23 on the pinion gear 13 side, that is, instead of the configuration in FIG. 9, the sliding resistance part 51 may be disposed on the helical spline 23 of the pinion gear 13 side, or the sliding resistance part 51 may be disposed on each of the helical splines 23 and 31.

When the motor rotates as shown in FIG. 8B, the force transmission surfaces of the helical splines 23, 31 are opposite to those when the pinion gear is pushed out, and the teeth surface f1 (driving surface) of the spline teeth 31*a* of the helical spline 31 is pressed against the helical spline 23 in the pinion gears 13 side.

As a result, the pinion gear 13 rotates in accordance with the rotation of the motor 11.

According to the second embodiment described above, since the sliding resistance part 51 is disposed on the teeth surface of at least one of the helical splines 31, 23 in the rotating shaft 12 side and the pinion gear 13 side, the sliding resistance is imparted to the both of helical splines 31, 23 when they mutually slide.

Then, due to the sliding resistance, the rotation and the movement in the axial direction of the pinion gear 13 are restricted.

As a result, the moving speed of the pinion gear 13 is restricted, and consequently the collision noise generated when the pinion gear 13 collides with the ring gear 100 can be reduced.

Other Embodiments

The above embodiments may be modified as follows, for example.

The configuration in which the restricting part (buffer member 27) is disposed between the end face in the axial direction of the pinion gear 13 and the lever receiving member 24 may be modified as follows.

For example, a buffer member may be attached to at least one of the end face in the axial direction of the pinion gear 13 and the end face of the lever receiving member 24 (more specifically, the end face of the opposing portion 25) so as to protrude from the end face.

That is, it is constituted that the buffer member is directly attached to at least one of the pinion gear 13 and the lever receiving member 24.

In this case, the buffer member does not necessarily have to be circular, but it may be provided in a state of being scattered in a circumferential direction, that is, in a state in which a plurality of buffer members are separated from each other in the circumferential direction.

A restricting member not having elasticity may be disposed as a restricting part.

In this case, the restricting member can be anything as long as the restricting member is disposed between the end face in the axial direction of the pinion gear 13 and the lever receiving member 24, and when the lever receiving member 24 moves, the restricting member restricts the relative rotation between the pinion gear 13 and the lever receiving member 24 by the frictional force.

What is claimed is:

1. A starter for an internal combustion engine comprising:

a rotating shaft formed with a helical spline on an outer periphery thereof and which rotates by a rotation of a motor;

a pinion gear helically splined to the rotating shaft and movable in an axial direction of the rotating shaft along a tooth surface of the helical spline;

a receiving member disposed opposing an end surface in an axial direction of the pinion gear, moved by receiving an axial pushing force by a pushing member, and causing the pinion gear to engage with a ring gear of the internal combustion engine by a movement thereof, the pinion gear being configured to be rotatable relative to the receiving member; and a restricting part for restricting a movement of the pinion gear in a rotational direction when the pinion gear moves along the teeth surface of the helical spline, wherein the restricting part is disposed between an end face in the axial direction of the pinion gear and the receiving member, and restricts relative rotation between the pinion gear and the receiving member by a frictional force when the receiving member moves, wherein the restricting part is a buffer member haying elasticity, the buffer member being disposed between the end face in the axial direction of the pinion gear and the receiving member, and wherein a contact area of the buffer member with at least one of the pinion gear and the receiving member is larger in a moving state in which the receiving member is moving and the buffer member is elastically deformed than in a state where the receiving member is not moving and the buffer member is not elastically deformed.

2. The starter for the internal combustion engine according to claim 1, wherein the buffer member has a low friction surface on a side facing at least one of the end face in the axial direction of the pinion gear and an end face of the receiving member.

3. The starter for the internal combustion engine according to claim 1, wherein a helical spline in the pinion gear side engaging with the helical spline in the rotating shaft side is formed at a radial center portion of the pinion gear; and a sliding resistance part, as the restricting part, serving as a resistance when the two helical splines slide relative to each other is provided on a teeth surface to which a force is transmitted by contact when pushing out the pinion gear in at least one of the spline in the rotating shaft side and the spline in the pinion gear side.

4. A starter for an internal combustion engine comprising:

a rotating shaft formed with a helical spline on an outer periphery thereof and which rotates by a rotation of a motor;

a pinion gear helically splined to the rotating shaft and movable in an axial direction of the rotating shaft along a tooth surface of the helical spline;

a receiving member disposed opposing an end surface in an axial direction of the pinion gear, moved by receiving an axial pushing force by a pushing member, and causing the pinion gear to engage with a ring gear of the internal combustion engine by a movement thereof, the pinion gear being configured to be rotatable relative to the receiving member; and a restricting part for restricting a movement of the pinion gear in a rotational direction when the pinion gear moves along the teeth surface of the helical spline, wherein the restricting part is disposed between an end face in the axial direction of the pinion gear and the receiving member, and restricts relative rotation between the pinion gear and the receiving member by a frictional force when the receiving member moves, and wherein the restricting part comprises an elastic body and a low friction sheet disposed on a side of the elastic body facing at least one of the end face in the axial direction of the pinion gear and an end face of the receiving member, the low friction sheet having a surface friction coefficient lower than a surface friction coefficient of the elastic body.

* * * * *